US005152932A

United States Patent [19]

Mueller et al.

[11] Patent Number: 5,152,932

[45] Date of Patent: * Oct. 6, 1992

[54] FORMATION OF HIGH ACTIVE DETERGENT GRANULES USING A CONTINUOUS NEUTRALIZATION SYSTEM

[75] Inventors: Frank J. Mueller, Cincinnati, Ohio; Lester J. Hollihan, Alexandria, Ky.

[73] Assignee: The Procter & Gamble Company, Cincinnati, Ohio

[ * ] Notice: The portion of the term of this patent subsequent to Nov. 19, 2008 has been disclaimed.

[21] Appl. No.: 647,338

[22] Filed: Jan. 28, 1991

Related U.S. Application Data

[63] Continuation-in-part of Ser. No. 364,721, Jun. 9, 1989, abandoned.

[51] Int. Cl.[5] ..... C11D 4/02; C11D 13/20; C11D 13/18

[52] U.S. Cl. ..... 252/550; 252/174; 252/553; 252/558; 252/174.21; 252/174.22; 252/174.23

[58] Field of Search ..... 252/550, 553, 558, 559, 252/174.21, 174.22, 174.23, 174

[56] References Cited

U.S. PATENT DOCUMENTS

| | | | |
|---|---|---|---|
| 3,178,370 | 4/1965 | Okenfuss . | |
| 3,838,072 | 9/1974 | Smith et al. | 252/540 |
| 3,868,336 | 2/1975 | Mazzola et al. | 252/527 |
| 4,140,657 | 2/1979 | Okumura et al. . | |
| 4,162,994 | 7/1979 | Kowalchek | 252/532 |
| 4,248,911 | 2/1981 | Wixon | 427/214 |
| 4,260,651 | 4/1981 | Wixon | 427/214 |
| 4,261,917 | 4/1981 | Hayashi et al. | 252/550 |
| 4,339,335 | 7/1982 | Wixon | 252/8.8 |
| 4,347,152 | 8/1982 | Wixon | 252/174 |
| 4,411,809 | 10/1983 | Wixon | 252/91 |
| 4,427,417 | 1/1984 | Porasik . | |
| 4,482,470 | 11/1984 | Reuter et al. | 252/162 |
| 4,487,710 | 12/1984 | Kaminsky | 252/546 |
| 4,490,271 | 12/1984 | Spadini et al. | 252/174.23 |
| 4,495,092 | 1/1985 | Schmid et al. | 252/559 |
| 4,515,707 | 5/1985 | Brooks | 252/368 |
| 4,532,076 | 7/1985 | Schmid et al. | 252/557 |
| 4,544,493 | 10/1985 | Silvis | 252/89.1 |
| 4,637,891 | 1/1987 | Delwel et al. | 252/135 |
| 4,639,326 | 1/1987 | Czempik et al. | 252/91 |
| 4,657,693 | 4/1987 | Wise et al. | 252/174.21 |
| 4,663,071 | 5/1987 | Bush et al. . | |
| 4,666,738 | 5/1987 | Wixon | 427/214 |
| 4,666,740 | 5/1987 | Wixon | 427/214 |
| 4,668,438 | 5/1987 | Pierr et al. | 260/400 |
| 4,675,128 | 6/1987 | Linde et al. | 252/549 |
| 4,690,785 | 9/1987 | Mausner et al. . | |
| 4,695,284 | 9/1987 | Hight . | |
| 4,715,284 | 12/1987 | Moore . | |
| 4,772,426 | 9/1988 | Koch et al. | 252/549 |
| 4,803,010 | 2/1989 | Ogino et al. | 252/174.21 |
| 4,826,632 | 5/1989 | Blackburn et al. | 252/550 |
| 4,828,721 | 5/1989 | Bollier et al. . | |
| 4,869,843 | 9/1989 | Saito et al. | 252/135 |
| 4,919,847 | 4/1990 | Barletta et al. | 252/558 |
| 4,925,585 | 5/1990 | Strauss et al. | 252/89.1 |
| 4,970,017 | 11/1990 | Nakamura et al. | 252/174.13 |
| 5,000,978 | 3/1991 | Davidson . | |

FOREIGN PATENT DOCUMENTS

| | | |
|---|---|---|
| 0080222 | 6/1983 | European Pat. Off. . |
| 0110731 | 12/1983 | European Pat. Off. . |
| 0129276 | 12/1984 | European Pat. Off. . |
| 266847A | 5/1988 | European Pat. Off. . |
| 4861511 | 8/1973 | Japan . |
| 56118498 | 9/1981 | Japan . |
| 60-72999 | 4/1985 | Japan . |
| 86-333245 | 5/1985 | Japan . |
| 61-69898 | 4/1986 | Japan . |
| 61-69900 | 4/1986 | Japan . |
| 61-118500 | 6/1986 | Japan . |
| 61-231099 | 10/1986 | Japan . |
| 62-45696 | 2/1987 | Japan . |
| 62-68897 | 3/1987 | Japan . |
| 62-218499 | 9/1987 | Japan . |
| 62-263299 | 11/1987 | Japan . |
| 63-92699 | 4/1988 | Japan . |
| 1488352 | 10/1977 | United Kingdom . |
| 2112801 | 7/1983 | United Kingdom . |

OTHER PUBLICATIONS

U.S. Patent Application Ser. No. 213,575, Strauss et al., filed Jun. 29, 1988 (now U.S. Pat. No. 4,925,585).

Pending U.S. Patent Applications Ser. No. 364,725, Jolicoeur, filed Jun. 9, 1989.

Pending U.S. Patent Application Ser. No. 364,732, Jolicoeur et al., filed Jun. 9, 1989 (allowed).

"Manufacture of Finished Detergents", A. S. Davidsohn and B. Milwidsky, Synthetic Detergents, 7th Ed.

"Detergent Production with Novel Blenders", Soap & Chemical Specialties Dec. 1968.

"Agglomeration—The Practical Alternative", S. A. Kuti, Journal of the American Oil Chemists' Society, vol. 55, No. 1, pp. 141–143 (1978).

*Primary Examiner*—Paul Lieberman
*Assistant Examiner*—Kery A. Fries
*Attorney, Agent, or Firm*—Kathleen M. Harleston; Donald E. Hasse; Thomas H. O'Flaherty

[57] ABSTRACT

A process for making high active detergent particles by: (a) reacting in a continuous neutralization system alkyl sulfuric acid and /or alkyl benzene sulfonic acid with concentrated sodium hydroxide solution, (b) adding to the system polyethylene glycol of molecular weight about 4,000–50,000 and/or certain ethoxylated nonionic surfactants, and (c) forming detergent particles. Granular detergent compositions containing the detergent granules are also described.

24 Claims, No Drawings

FORMATION OF HIGH ACTIVE DETERGENT GRANULES USING A CONTINUOUS NEUTRALIZATION SYSTEM

REFERENCE TO RELATED APPLICATION

This application is a continuation-in-part of U.S. patent application Ser. No. 364,721, filed Jun. 9, 1989.

FIELD OF THE INVENTION

The present invention relates to a process for making high active detergent particles, and to detergent particles made by this process. More particularly, this process comprises the following steps:

(a) reacting alkyl sulfuric and/or alkyl benzene sulfonic acids with concentrated sodium hydroxide solution (greater than or equal to about 62 weight % hydroxide) in a continuous neutralization system;

(b) adding polyethylene glycol of molecular weight about 4,000 to 50,000 and/or certain ethoxylated nonionic surfactants during neutralization; and (c) forming detergent particles.

BACKGROUND INFORMATION

There is currently interest in the detergent industry in concentrated detergent products. These products provide advantages to the consumer, who has a product which can be used in lower amounts and is more easily stored, and to the producer and intermediates, who have lower transportation and warehousing costs. A major difficulty, though, is finding an inexpensive and efficient way to produce a high active detergent particle for inclusion in a concentrated detergent product. By "high active" is meant greater than about 50% active.

The traditional method for producing detergent granules is spray drying. Typically, detergent ingredients such as surfactant, builder, silicates and carbonates are mixed in a mix tank to form a slurry which is about 35% to 50% water. This slurry is then atomized in a spray drying tower to reduce moisture to below about 10%. It is possible to compact spray dried particles to make dense detergent granules. See U.S. Pat. No. 4,715,979, Moore et al., issued Dec. 29, 1987. However, the use of spray drying to make condensed granules has some disadvantages. Spray drying is energy intensive and the resulting granules are typically not dense enough to be useful in a concentrated detergent product. Spray drying methods generally involve a limited amount (less than 40%) of organic components such as surfactant for environmental and safety reasons.

One way to reduce the energy required to spray dry detergent granules is to reduce the moisture in the slurry which is atomized in the spray drying tower, i.e., by reducing the evaporative load. An alternative method for making a high active detergent particle is by continuous neutralization in, for example, a continuous neutralization loop. There are continuous neutralization loops available to which relatively concentrated caustic can be added. Using a caustic solution which is about 50% sodium hydroxide allows reduction of moisture in the resulting neutralized surfactant paste to about 16% water. However, caustic of greater than about 50% solids cannot easily be added to existing continuous neutralization systems because the systems cannot reliably accommodate the viscous surfactant paste nor are the systems designed to accomodate the high temperatures necessary to handle concentrated caustic solutions. It has heretofore not been practical to use a continuous neutralization system to attain low moisture levels (below about 12%) in the paste so that free-flowing, high active detergent granules can be made from the paste.

The following publications describe ways to make free-flowing high active particles without drying, using surfactant paste, and made with a continuous neutralization system.

Japanese Patent 61-118500, Hara et al., laid-open Jun. 5, 1986, discloses a method for the manufacture of concentrated detergent compositions characterized by kneading the materials of the detergent composition continuously, and feeding these materials, which contain at least 30% by weight of surfactant, into an airtight-type kneader with a controlled pressure of 0.01–5 $kg/cm^2G$.

Japanese Patent 60-072999, Satsusa et al., laid open Apr. 25, 1985, discloses a production method for a highly concentrated powder detergent where sulfonate and/or sulfate is mixed with sodium carbonate and water in a high shear mixer, cooled below 40° C., and then pulverized with a zeolite powder and other detergent components.

The use of polyethylene glycol and ethoxylated nonionic surfactants in granular detergent compositions is known in the art. For example, Japanese Patent 61-231099, Sai et al., laid-open Oct. 15, 1986, discloses concentrated powdered detergents containing (a) anionic surfactant, (b) polycarboxylic acid polymer or their salts, (c) polyethylene glycol, in certain percentages and weight ratios. The detergent also contains 0–10% by weight of a water-soluble neutral inorganic salt.

Japanese Patent 62-263299, Nagai et al., laid-open Nov. 16, 1987, discloses a method for the preparation of granular nonionic detergent composition by first kneading and mixing 20–50 weight % of nonionic surfactant at a temperature not above 40° C., and 50–80 weight % of a mixture of zeolite, and lightweight sodium carbonate in a specified ratio, followed by granulation.

Patents exist which describe processes and/or surfactant compositions comprising viscosity modifiers such as polyethylene glycol and ethoxylated ($E_{20-60}$) alkyl ($C_{6-12}$) phenol. U.S. Pat. No. 4,482,470, Reuter et al., issued Nov. 13, 1984 discloses a process for reducing the viscosity of aqueous concentrates of anionic surfactants by adding a small quantity of a compound containing polyglycol ether groups; and the aqueous concentrates prepared thereby. Polyethylene glycol having a molecular weight of from about 600 to about 6,000 and ethoxylated ($E_{20-80}$) alkyl ($C_{6-12}$) are named as viscosity modifiers.

U.S. Pat. No. 4,495,092, Schmid et al., issued Jan. 22, 1985 discloses the addition of $C_{8-40}$ alcohols, or $C_{8-40}$ alcohols containing one or more hydroxyl groups and 20 moles of ethylene oxide and/or propylene oxide, to aqueous industrial anionic surfactants in order to significantly improve the rheological behavior thereof. The alcohols are apparently added in quantities of from about to about 15% by weight, based on the quantity of surfactant, whereupon the viscosity of the surfactant concentrate becomes at most 10,000 mPas at 70° C.

U.S. Pat. No. 4,532,076, Schmid et al., issued Jul. 30, 1985 discloses an aqueous anionic surfactant concentrate with certain low molecular weight organic compounds as viscosity regulators, and a method of regulating the viscosity of highly viscous concentrates.

None of the above disclose the instant process for making high active detergent particles from the high active paste made by reacting alkyl sulfuric and/or alkyl benzene sulfonic acids with concentrated caustic in a continuous neutralization system in which polyethylene glycol and/or certain ethoxylated nonionics are added during neutralization in specified proportions.

SUMMARY OF THE INVENTION

The present invention relates to a process for producing high active detergent particles, comprising the steps of:

(a) reacting in a continuous neutralization system $C_{12-18}$ alkyl sulfuric acid, or $C_{10-16}$ alkyl benzene sulfonic acid, or mixtures thereof with sodium hydroxide solution, which is greater than or equal to about 62% by weight of the hydroxide, to produce a neutralized product;

(b) adding to said continuous neutralization system during formation of said neutralized product, polyethylene glycol of a molecular weight between about 4,000 and 50,000; ethoxylated nonionic surfactant of the formula $R(OC_2H_4)_nOH$, wherein R is a $C_{12-18}$ alkyl group or a $C_{8-16}$ alkyl phenol group and n is from about 9 to about 80, with a melting point of greater than or equal to about 120° F. (48.9° C.); or mixtures thereof;

wherein the weight ratio of the additive of step (b) to the product of step (a) is from about 1:5 to about 1:20; and (c) forming detergent particles.

DESCRIPTION OF THE INVENTION

This invention includes a process for making detergent particles which are more than about 50% active. Detergent particles made by this process are also included. The steps of the process are as follows.

I. Addition of Acid and Caustic

The first step of this process is neutralizing in a continuous neutralization system $C_{12-18}$ alkyl sulfuric acid, or $C_{10-16}$ alkyl benzene sulfonic acid, or mixtures thereof with a sodium hydroxide solution, which is greater than or equal to about 62% by weight of the hydroxide, preferably without kneading, to produce a neutralized product. The neutralized product preferably has less than or equal to about 12% by weight of water.

It is preferred that the materials of the detergent composition not be kneaded in the continuous neutralization system. The continuous neutralization system preferably does not include an airtight-type kneader.

It is preferred that the continuous neutralization system be substantially free of additional crude materials of the detergent composition. In other words, crude materials other than surfactant, caustic and/or polyethylene glycol are preferably not fed into the system. For example, less than about 5%, preferably less than about 1%, of additional crude materials should be present in the continuous neutralization system. It is most preferred that essentially no detergency builders or additional organic materials are fed into the continuous neutralization system.

The $C_{12-18}$ alkyl sulfuric acid and $C_{10-16}$ alkyl benzene sulfonic acid can be made by any sulfation/sulfonation process, but preferably are sulfonated with $SO_3$ in air in a falling film reactor. See *Synthetic Detergents*, 7th ed., A. S. Davidson & B. Milwidsky, John Wiley & Sons, Inc., 1987, pp. 151–168.

$C_{12-18}$ alkyl sulfuric acid, and mixtures of it and $C_{10-16}$ linear alkyl benzene sulfonic acid, are preferred for use herein. Mixtures of the two are most preferred because of improved dispersibility of detergent particles formed from a paste made with the mixture. The two acids can be added as separate streams to the continuous neutralization system or mixed before addition. Alternatively, pastes made from each separate acid can be mixed after neutralization.

In this process, it is preferred that the final ratio of $C_{12-18}$ sodium alkyl sulfate to $C_{10-16}$ sodium linear alkyl benzene sulfonate be between 75:25 and 96:4, preferably between 80:20 and 95:5.

An 88:12 ratio of $C_{14-15}$ sodium alkyl sulfate to $C_{12-13}$ sodium linear alkyl benzene sulfonate is most preferred because the neutralized material is not unacceptably sticky, yet the particles formed from the cooled paste are dispersible in 60° F. (15.5° C.) water. Paste made from about 100% alkyl sulfuric acid (including impurities) is in contrast not very dispersible in cool (60° F.) water despite its desirable consistency. Paste made from alkyl benzene sulfonic acid alone is soft and sticky and therefore difficult to form into nonsticky, discrete surfactant particles.

$C_{14-16}$ alkyl sulfuric acid is preferred for use in step (a) of this process over $C_{12-18}$ alkyl sulfuric acid. $C_{14-15}$ alkyl sulfuric acid is most preferred.

$C_{11-14}$ linear alkyl benzene sulfonic acid is preferred over $C_{10-16}$ alkyl benzene sulfonic acid. $C_{12-13}$ linear alkyl benzene sulfonic acid is most preferred for use herein.

The sodium hydroxide used in step (a) to neutralize the alkyl sulfuric acid and/or alkyl benzene sulfonic acid is greater than or equal to about 62%, preferably greater than or equal to about 68%, most preferably about 73%, by weight of the hydroxide. This highly concentrated caustic solution melts at a high temperature so the caustic feed system must be carefully maintained at the required temperature to prevent "cold spots". A "cold spot" is any point in the feed system, pumps, metering systems, pipes or valves where the system has reached a temperature below the melting point of the caustic (155° F. or 68.3° C. for 73% caustic, for example). Such a "cold spot" can cause crystallization of the caustic and blockage of the feed system. Typically "cold spots" are avoided by hot water jackets, electrical tracing, and electrically heated enclosures.

The neutralized product formed by the acid and caustic is in the form of a molten paste. When about 62% active caustic is used, the molten paste ordinarily has about 12% by weight of water. When 73% active caustic is used, the molten paste ordinarily has between about 9 and 11% by weight of water. It is most preferred that the alkali metal hydroxide be about 73% by weight of hydroxide and that the molten paste be between 9% and 11% by weight of water.

The sodium hydroxide is preferably present in slight excess of the stoichiometric amount necessary to neutralize the acid. If reserve alkalinity (excess caustic) in the neutralization system exceeds about 1.5% $M_2O$ (where M is metal), the paste is difficult to circulate through the continuous neutralization system because of its high viscosity. If reserve alkalinity drops below about 0.1%, the alkyl paste may not be stable long term because of hydrolysis. It is therefore preferred that reserve alkalinity, which can be measured by titration with acid, of the molten paste in the neutralization system be between about 0.1% and 1.5%, more preferably between about 0.2% and 1.0%, most preferably between about 0.3% and 0.7%.

The acid and caustic are put into the continuous neutralization system separately, preferably via a high shear mixer so that they mix together as rapidly as possible. The high shear mixer is preferably specifically designed for complete mixing of viscous liquids.

Generally, in a continuous neutralization loop, the ingredients enter the system through a pump (typically centrifugal) which circulates the material through a heat exchanger in the loop and back through the pump, where new materials are introduced. The material in the system continually recirculates, with as much product exiting as is entering. Product exits through a control valve which is usually after the pump. The recirculation ratio of a continuous neutralization loop is between about 1:1 and 50:1. The temperature of the neutralization reaction can be controlled to a degree by adjusting the amount of cooling by the heat exchanger. The "throughput" can be controlled by modifying the amount of acid and caustic introduced.

The continuous neutralization loop should be modified as follows to practice this process:

(1) Insulate the loop;
(2) Change the centrifugal pump to a positive displacement pump, which is better able to handle very viscous material;
(3) Install a caustic feed system which can handle concentrated caustic (greater than about 50% solids);
(4) Introduce materials through a high shear mixer installed in-line;
(5) Install a metering system for the polyethylene glycol and/or ethoxylated nonionic surfactant, preferably after the high shear mixer; and
(6) Position the incoming streams of acid and caustic at the high shear mixer so that the highest degree of mixing possible takes place.
(7) The temperature of the loop should be sufficiently high to achieve a low viscosity of the paste to ensure adequate recirculation and mixing. The temperature should not be so high however that it causes hydrolysis of the alkyl sulfuric acid or the alkyl sulfate. Typical paste temperatures in the loop are between about 180° F. (82.2° C.) and 230° F. (110° C.), preferably about 200° F. (93.3° C.) to 210° F. (98.9° C.).

II. Addition of Polyethylene Glycol and/or Ethoxylated Nonionic Surfactant

The second step of this process is adding to the continuous neutralization system during formation of the neutralized product polyethylene glycol of a molecular weight between about 4,000 and 50,000 and/or ethoxylated nonionic surfactant of the formula $R(OC_2H_4)_nOH$, wherein R is a $C_{12-18}$ alkyl group or a $C_{8-16}$ alkyl phenol group and n is from about 9 to about 80, with a melting point greater than or equal to about 120° F. (48.9° C.). The weight ratio of the additive of step (b) to the mixture of step (a) is from about 1:5 to about 1:20.

The polyethylene glycol and/or the ethoxylated nonionic surfactant can be added separately or as a mixture to the continuous neutralization system at any point. In a neutralization loop, these additive(s) preferably enter the loop after the high shear mixer and before the recirculation pump. The additives must be melted before addition to the neutralization system, so that they can be metered in.

These two additives are chosen because they enhance detergent performance and are solid at below about 120° F. (48.9° C.), so that a detergent particle which is firm at ambient temperature can be made from the neutralized paste. They are also chosen because each additive acts as a process aid by reducing the viscosity of the high active paste in the neutralizer loop. This viscosity reduction is particularly important during the start up of the neutralizer loop where the surfactant concentration is increased through the "middle phase" region. Some alkyl sulfate chain lengths have very high "middle phase" viscosities—typically between concentrations of 40% and 60%.

Polyethylene glycol of a molecular weight between about 4,000 and 50,000 is preferred over the ethoxylated nonionic surfactants. Polyethylene glycol of a molecular weight between about 7,000 and 12,000 is more preferred, and most preferred is polyethylene glycol with a molecular weight of 8,000 ("PEG 8,000"). In this invention, the preferred weight ratio of polyethylene glycol to the acid/caustic mixture of step (a) is from about 1:8 to about 1:12. For polyethylene glycol with a molecular weight of 8,000, the preferred weight ratio is one part PEG 8,000 to ten parts acid/caustic mixture.

Polyethylene glycol is formed by the polymerization of ethylene glycol with ethylene oxide in an amount sufficient to provide a compound with a molecular weight between about 4,000 and 50,000. It can be obtained from Union Carbide (Danbury, Conn.).

The preferred ethoxylated nonionic surfactant material is of the formula $R(OC_2H_4)_nOH$, wherein R is a $C_{12-18}$ alkyl group and n is from about 12 to about 30. Most preferred is tallow alcohol ethoxylated with 18 moles of ethylene oxide per mole of alcohol ("TAE 18"). The preferred melting point for the ethoxylated nonionic surfactant is greater than about 140° F. (60° C.).

Examples of other ethoxylated nonionics herein are the condensation products of one mole of decyl phenol with 9 moles of ethylene oxide, one mole of dodecyl phenol with 16 moles of ethylene oxide, one mole of tetradecyl phenol with 20 moles of ethylene oxide, or one mole of hexadecyl phenol with 30 moles of ethylene oxide.

A buffer, preferably disodium glutamate, can be incorporated into the continuous neutralizer system in order to control pH. A buffer which does not form carbon dioxide upon exposure to local acid conditions in the neutralization system should be used. In this case, rather than controlling reserve alkalinity, the pH in the system should be controlled to between about 8.5 and 11, preferably between about 9 and 10. Disodium glutamate is preferred and is preferably added at a level of between about 0.5 and 5%, more preferably between about 1 and 3%, most preferably between about 1.5 and 2%, of the neutralized product.

III. Formation of Particles

The third and final step of this process is forming detergent particles from the product of step (b). Detergent particles can be formed in various ways from the neutralized product exiting the continuous neutralization system. A desirable detergent particle size distribution has a range of about 100 to 1200 microns, preferably about 150 to 600 microns, with an average of 300 microns.

The molten paste from a continuous neutralization loop can be atomized into droplets in a prilling (cooling) tower. To avoid prilling at all, the molten paste can be simultaneously cooled and extruded, and cut or ground into desirable particle sizes.

A third choice is to allow the molten paste to cool on a chill roll, or any heat exchange unit until it reaches a doughy consistency, at which point other detergent ingredients can be kneaded in. The resulting dough can then be granulated by mechanical means.

A fourth and preferred choice is to cool the molten paste into flakes on a chill roll, then grind the flakes to the desired particle size. If additional drying is required, the cooled flakes can be dried in a rotary drum with hot air or in a fluid bed prior to grinding.

The resulting detergent particles are preferably admixed in dry form with other detergent composition ingredients. For example, the instant detergent particles can be admixed with spray dried linear alkyl benzene sulfonate particles (with or without detergency builder) to make a granular detergent product which cleans well.

Appropriate full detergent compositions contain from about 5 to 95% by weight of the instant high active detergent particles, from 0 to about 95% by weight of additional detergent surfactant, from 0 to about 85% by weight of detergency builder, from 0 to about 50% by weight of fabric care agent, and from 0 to about 20% by weight of percarboxylic acid bleaching agents.

The additional detergent surfactant referred to immediately above is selected from the group consisting of anionic, cationic, nonionic, amphoteric, and zwitterionic surfactants, and mixtures thereof. Examples of surfactants of these types are described in U.S. Pat. No. 3,579,454, Collier, issued May 18, 1971, incorporated herein by reference, from Column 11, line 45 through Column 13, line 64. An extensive discussion of surfactants is contained in U.S. Pat. No. 3,936,537, incorporated herein by reference, particularly Column line 39 through Column 13, line 52. Anionic synthetic surfactants are particularly preferred.

Cationic surfactants can also be included in such full detergent compositions. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Other optional ingredients which may be included in the full detergent compositions herein include detergency builders, chelating agents, bleaching agents, antitarnish and anticorrosion agents, perfume and color additives, and other optional ingredients enumerated in the Baskerville patent, U.S. Pat. No. 3,936,537, from Column 19, line 53 through Column 21, line 21, incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference. Detergency builders are enumerated in the Baskerville patent from Column 13, line 54 through Column 16, line 16, and in U.S. Pat. No. 4,663,071, Bush et al., issued May 5, 1987, both incorporated herein by reference. Such builders include, for example, phosphates, aluminosilicates, silicates, carbonates. $C_{10}$-$C_{18}$ alkyl monocarboxylates, polycarboxylates, and polyphosphonates, and mixtures thereof.

Fabric care agents are optionally included in such full detergent compositions. These include known fabric softeners and antistatic agents, such as those disclosed in U.S. Pat. No. 4,762,645, Tucker et al., issued Aug. 9, 1988, incorporated herein by reference. The smectite clays described therein may also be included in the full detergent compositions.

Percarboxylic acid bleaching agents, or bleaching compositions containing peroxygen bleaches capable of yielding hydrogen peroxide in an aqueous solution and bleach activators at specific molar ratios of hydrogen peroxide to bleach activator, may also be included. These bleaching agents are fully described in U.S. Pat. No. 4,412,934, Chung et al., issued Nov. 1, 1983, and in U.S. Pat. No. 4,483,781, Hartman, issued Nov. 20, 1984, both of which are incorporated herein by reference.

The following nonlimiting examples illustrate the process and detergent particles of the present invention. All parts, percentages and ratios herein are by weight unless otherwise specified.

EXAMPLE I

Preparation of a high active detergent material suitable for granulation to a free flowing particulate is as follows.

Equipment

A falling film $SO_3$ reactor is used to prepare the acid form of $C_{14-15}$ alkyl sulfate. The acid is fed to a high active neutralization system supplied by Chemithon Corporation of Seattle, Wash. This customized neutralization system consists of a recycle loop containing a heat exchanger for cooling, a recirculation pump suitable for highly viscous fluids, and a high shear mixer with which the reactants are introduced.

In order to attain the very low moisture levels necessary for a free-flowing, high active particles, the neutralization loop is modified to handle 73% sodium hydroxide melt rather than the 38–50% normally used with the neutralization loop. This modification consists of hot water jackets and electrical heating of the caustic feed system to maintain the 73% caustic above the caustic melting point of about 155° F. (68.3° C.).

Another necessary modification is the addition of a metering system which injects the polyethylene glycol into the neutralization loop at the discharge side of the high shear mixer. The presence of the polyethylene glycol facilitates pumping of the paste in the recirculation loop and reduces stickiness of the finished material. Polyethylene glycol having a molecular weight of about 8000 is added as a melt (about 160° F. or 71.1° C.) at a rate of about 1 part polyethylene glycol 8000 to 10 parts $C_{14-15}$ sodium alkyl sulfate active.

Operation

At start up, the neutralization loop is filled with water and the system is maintained at 180°-230° F. (82.2°-110° C.) by using hot water in the heat exchanger and in the double wall pipe comprising the recycle loop. The recycle pump and high shear mixer are started.

The 73% sodium hydroxide and $C_{14-15}$ alkyl sulfuric acid are introduced into the high shear mixer. The sodium hydroxide and $C_{14-15}$ alkyl sulfuric acid are metered to allow a slight excess of sodium hydroxide. Material displaced from the recirculation loop is discharged through a back pressure control valve.

As operation continues, the water is displaced from the loop and the concentration of the sodium $C_{14-15}$ alkyl sulfate is increased. The high viscosity of the middle phase (40-60% active) is reduced by the presence of polyethylene glycol. After the feed volumes reach four to six times the volume of the neutralizer, the surfactant concentration reaches 70% or over. Operation is continued until the desired amount of high active, low moisture material is produced. The reactant feed is then shut off and the reaction loop is washed with hot water.

Results

The molten paste produced is cooled and manually ground to a free-flowing particulate product having the following composition.

| | |
|---|---|
| Sodium $C_{14-15}$ alkyl sulfate | 74.9% |
| Polyethylene glycol 8000 | 7.5 |
| Water | 10.1 |
| Sodium hydroxide | 0.6 |
| Unreactants/miscellaneous | 6.9 |

Disodium glutamate (1.8%) can alternately be introduced to the continuous neutralization loop. In that case, pH is controlled to between 9 and 10.

EXAMPLE II

Polyethylene glycol with a molecular weight of about 8000 is added to sodium $C_{14-15}$ alkyl sulfate to reduce its stickiness and make it suitable for granulating into free-flowing particles with low stickiness. The test sample is prepared by incorporating the polyethylene glycol 8000 into a quantity of sodium $C_{14-15}$ alkyl sulfate paste (made according to Example I) containing about 65% water, by mixing and then drying the product on a steam heated roll drier to less than 10% moisture. The polyethylene glycol 8000 is added at a ratio of 1 part of polyethylene glycol 8000 to 10 parts of sodium $C_{14-15}$ alkyl sulfate active. A control sample without polyethylene glycol is prepared in a similar manner. The material falls off the roll drier as dried flakes, which are manually ground and sieved through 14 mesh or 65 mesh.

Stickiness is measured by compressing a 2½ diameter×2½ long cylinder of granules for 1 minute with a 20 pound weight. A force gauge is used to collapse the cylinder of granules. The force required, referred to as "cake grade", is measured and recorded as a measure of stickiness.

| | Composition A | Composition B |
|---|---|---|
| Sodium $C_{14-15}$ alkyl sulfate | 67 | 80 |
| Polyethylene glycol 8000 | 7 | 0 |
| Water | 7 | 6 |
| Unreacted sodium hydroxide and miscellaneous | Balance | Balance |

-continued

| CAKE GRADES (Pounds of Force) | Temperature | |
|---|---|---|
| | 80° F. (26.6° C.) | 140° F. (60° C.) |
| Composition A | 0.6 | 0.9 |
| Composition B | 12.4 | 22.2 |

These data show that the addition of polyethylene glycol 8000 results in a significantly lower cake grade, demonstrating that it reduces stickiness of the detergent particles.

EXAMPLE III

Polyethylene glycol with a molecular weight of about 8000 is added to sodium $C_{14-15}$ alkyl sulfate paste (made according to Example I) in a manner similar to Example II except that the polyethylene glycol 8000 is added at a ratio of 3 parts of polyethylene glycol 8000 to 10 parts of $C_{14-15}$ sodium alkyl sulfate active. Samples are roll dried and ground in the manner described in Example II. The samples are tested for caking as described in Example II, with the following results.

| CAKE GRADES (Pounds of Force) | Temperature | |
|---|---|---|
| | 80° F. (26.6° C.) | 140° F. (60° C.) |
| Composition containing 3/10 ratio of polyethylene glycol/ sodium $C_{14-15}$ alkyl sulfate | 1.1 | 2.2 |
| Control sample without polyethylene glycol 8000 | 12.4 | 22.2 |

These data show that the addition of polyethylene glycol 8000 results in a significantly lower cake grade, demonstrating that it reduces stickiness of the detergent particles. The ratio of 3:10 polyethylene glycol:alkyl sulfate is not significantly better at reducing cake grade than the 1:10 ratio of Example II.

EXAMPLE IV

In this example the falling film $SO_3$ reactor is used to prepare the acid form of $C_{12.3}$ linear alkyl benzene sulfonate. The acid is fed to the modified neutralization loop as described in Example I. Sodium hydroxide which is 70% by weight of the hydroxide is used. Polyethylene glycol with a molecular weight of 8,000 (PEG 8000) is added to the neutralization loop as described in Example I. A concentrated sodium $C_{12.3}$ linear alkyl benzene sulfonate is produced. The paste composition is 77.5% active, 8% PEG 8000, 9% water, the balance being excess caustic, unreacted material and miscellaneous.

The cooled sodium $C_{12.3}$ linear alkyl benzene sulfonate with polyethylene glycol is solid in nature but much more sticky than the sodium $C_{14-15}$ alkyl sulfate with polyethylene glycol prepared in Examples I and II.

EXAMPLE V

In this example high active sodium $C_{14-15}$ alkyl sulfate prepared as in Example I is mixed with the high active $C_{12.3}$ sodium linear alkyl benzene sulfonate prepared in Example IV in various ratios to study the dispersibility of the mixtures. All samples comprise polyethylene glycol 8000 in a 1:10 polyethylene glycol to alkyl sulfate or alkyl benzene sulfonate. To insure thorough mixing and simulate a co-neutralization of the two surfactants, the various ratios are mixed in a laboratory Sigma type mixer for 2 hours at a temperature of about 190° F. (87.8° C.)

The mixtures are allowed to cool and are formed into granules by forcing through a 14 mesh screen. Each sample is tested for dispersibility by agitation in 60° F. (15.5° C.) water for 10 minutes. The wash water is then filtered through a black cloth filter to determine the amount of undissolved surfactant.

The deposits on the cloth are graded on a 1 to 10 scale; 10 representing no visible deposit.

| Ratio Alkyl sulfate/alkyl benzene sulfonate | Black Fabric Grade |
|---|---|
| 100/0 | 5.5 |
| 94/6 | 9.0 |
| 88/12 | 9.5 |
| 75/25 | 10 |
| 50/50 | 10 |
| 25/75 | 10 |
| 0/100 | 10 |

As demonstrated by the data, a small amount of linear alkyl benzene sulfonate greatly improves the dispersibility of the detergent particle. As the level of linear alkyl benzene sulfonate is increased, the softness and stickiness of the particle increases. At high linear alkyl benzene sulfonate levels the particles are less suitable for use as detergent particles because of their stickiness. According to these data, the best compromise between low stickiness and good dispersibility is an alkyl sulfate/alkyl benzene sulfonate ratio of about 88/12.

What is claimed is:

1. A process for producing detergent particles which are more than about 50% active, comprising the steps of:

(a) reacting in a continuous neutralization loop $C_{12-18}$ alkyl sulfuric acid, or $C_{10-16}$ alkyl benzene sulfonic acid, or mixtures thereof with a sodium hydroxide solution, which is greater than or equal to about 62% by weight of the hydroxide, to produce a neutralized product;

(b) adding to said continuous neutralization loop during formation of said neutralized product, polyethylene glycol of a molecular weight between about 4,000 and 50,000; ethoxylated nonionic surfactant of the formula $R(OC_4H_4)_nOH$, wherein R is a $C_{12-18}$ alkyl group or a $C_{8-16}$ alkyl phenol group and n is from about 9 to about 80, with a melting point of greater than or equal to about 120° F. (48.9° C.); or mixtures thereof;

wherein the weight ratio of the additive of step (b) to the product of step (a) is from about 1:5 to about 1:20; and (c) forming detergent particles.

2. A process for producing detergent particles according to claim 1 wherein the materials of the detergent composition are not kneaded in the continuous neutralization loop.

3. A process for producing detergent particles according to claim 1 wherein said continuous neutralization loop is substantially free of additional crude materials.

4. A process for producing detergent particles according to claim 3 wherein said continuous neutralization loop does not include an airtight-type kneader.

5. A process for producing detergent particles according to claim 2 wherein essentially no detergency builders or additional organic materials are fed into said continuous neutralization loop.

6. A process for producing detergent particles according to claim 5 wherein said neutralized product has less than or equal to about 12% by weight of water.

7. A process for producing detergent particles according to claim 3 wherein step (a) comprises reacting said $C_{12-18}$ alkyl sulfuric acid, or a mixture of said $C_{12-18}$ alkyl sulfuric acid and $C_{10-16}$ linear alkyl benzene sulfonic acid, with said sodium hydroxide solution.

8. A process for producing detergent particles according to claim 7 wherein step (a) comprises reacting said mixture in a weight ratio of $C_{12-18}$ alkyl sulfuric acid to $C_{10-16}$ linear alkyl benzene sulfonic acid between about 75:25 and 96:4.

9. A process for producing detergent particles according to claim 8 wherein said mixture is of $C_{14-16}$ alkyl sulfuric acid and $C_{11-14}$ linear alkyl benzene sulfonic acid.

10. A process for producing detergent particles according to claim 3 wherein said alkyl benzene sulfonic acid is $C_{11-14}$ linear alkyl benzene sulfonic acid.

11. A process for producing detergent particles according to claim 3 wherein step (a) comprises reacting $C_{14-16}$ alkyl sulfuric acid with said sodium hydroxide solution.

12. A process for producing detergent particles according to claim 3 wherein said sodium hydroxide solution is about 73% by weight of the hydroxide, and said neutralized product has between about 9% and 11% by weight of water.

13. A process for producing detergent particles according to claim 3 wherein said neutralized product has a reserve alkalinity of between about 0.2% and 1.0%.

14. A process for producing detergent particles according to claim 3 wherein said step (c), forming detergent particles, is by means selected from the group consisting of granulating, grinding, extruding, prilling, and mixtures thereof.

15. A process for producing detergent particles according to claim 11 wherein said continuous neutralization loop is insulated and comprises a high shear mixer, positive displacement pump and a caustic feed system for caustic which is greater than or equal to about 62% by weight of the hydroxide.

16. A process for producing detergent particles according to claim 12 wherein incoming acid and caustic streams to said continuous neutralization loop are positioned at the high shear mixer, and step (b) additives are metered in after said high shear mixer and before said positive displacement pump in said neutralization loop.

17. A process for producing detergent particles according to claim 3 wherein said additive of step (b) is polyethylene glycol of a molecular weight between about 6,000 and 50,000.

18. A process for producing detergent particles according to claim 5 wherein said additive of step (b) is polyethylene glycol of a molecular weight between about 7,000 and 12,000.

19. A process for producing detergent particles according to claim 15 wherein said weight ratio of the additive of step (b) to the product of step (a) is 1:10.

20. A process for producing detergent particles according to claim 16 wherein said additive of step (b) is molten polyethylene glycol with a molecular weight of 8,000.

21. A process for producing detergent particles according to claim 3 wherein R is a $C_{12-18}$ alkyl group and n is from about 12 to about 30.

22. Detergent particles made according to claim 3.

23. Detergent particles made according to claim 20

24. A granular detergent composition comprising detergent particles made according to claim 3.

* * * * *